United States Patent [19]

Canela

[11] Patent Number: 4,807,604

[45] Date of Patent: Feb. 28, 1989

[54] SCALP MASSAGER

[76] Inventor: Heriberto Canela, 8027 W. 14 Ave., Hialeah, Fla. 33014

[21] Appl. No.: 131,680

[22] Filed: Dec. 11, 1987

[51] Int. Cl.[4] ..... A61H 9/00

[52] U.S. Cl. ..... 128/66; 128/65; 128/67; 4/516; 4/518; 4/618

[58] Field of Search ..... 128/65-67; 2/171.2, 171.4, 171.7, 181.6, 174, 410; 4/515-521, 606, 618; 239/101, 447; 604/150

[56] References Cited

U.S. PATENT DOCUMENTS

| | | | |
|---|---|---|---|
| 998,804 | 7/1911 | Salisbury | 4/521 |
| 2,813,275 | 11/1957 | Davenport | 128/66 |
| 2,854,970 | 10/1958 | Nolan | 4/517 |
| 2,856,918 | 10/1958 | Kingery et al. | 4/517 |
| 3,177,868 | 4/1965 | Wallace et al. | 4/517 |
| 3,416,517 | 12/1968 | Adams et al. | 128/65 |
| 3,575,181 | 4/1971 | Rudd | 4/516 |
| 3,599,250 | 8/1971 | Colomb | 4/517 |
| 3,963,179 | 6/1976 | Tomaro | 239/447 |
| 4,642,100 | 2/1987 | Kabbaby | 604/150 |
| 4,674,902 | 6/1987 | Turner | 4/516 |

*Primary Examiner*—Paul T. Sewell
*Assistant Examiner*—Aaron J. Lewis
*Attorney, Agent, or Firm*—J. Sanchelima

[57] ABSTRACT

A scalp massager connected to a tap water supply, such as a shower head, through a flexible conduit. The massager includes a pulsating water shower head that is slidably mounted along a plurality of slots in a helmet that is fitted over a user's head. The massaging shower head includes a locking nut for adjusting and setting the shower head in a given position to constantly apply the pulsating water over an area of the user's scalp.

4 Claims, 2 Drawing Sheets

SCALP MASSAGER

BACKGROUND OF THE INVENTION

1. Field of the Invention

The present invention relates to a scalp massager, and more particularly, to such a massager that is activated with pulsating water.

2. Description of the Prior Art

Several devices have been designed in the past for applying a pulsating jet of water to different parts of the body. However, none of these devices provide the means for adjusting this massaging jet of water on a particular area of the user's scalp without requiring the constant use of his or her hands.

SUMMARY OF THE INVENTION

It is one of the main objects of the present invention to provide a scalp massager that can be readily fitted to a conventional shower head for its water supply.

It is another object of this present invention to provide such a massager that can be easily used by a user without requiring the use of his or her hands.

It is still another object of this invention to provide such a massager that can be easily adjusted on a given position to apply the massaging action of the pulsating water in a particular section of the user's scalp.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
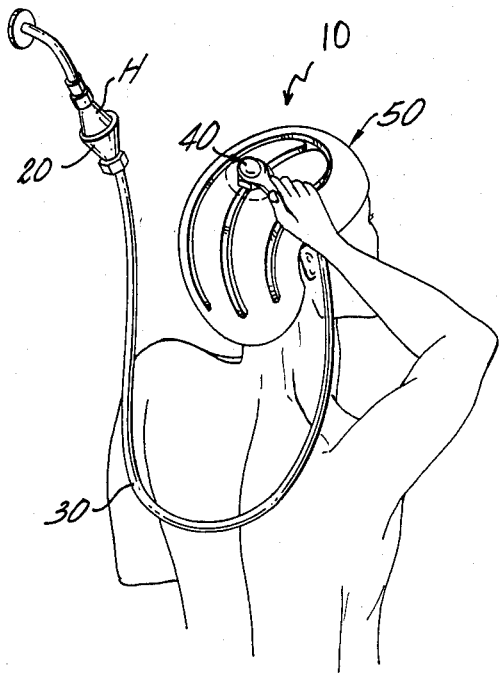
FIG. 1 represents the present invention in use and connected to a conventional shower head.
Figure 2:
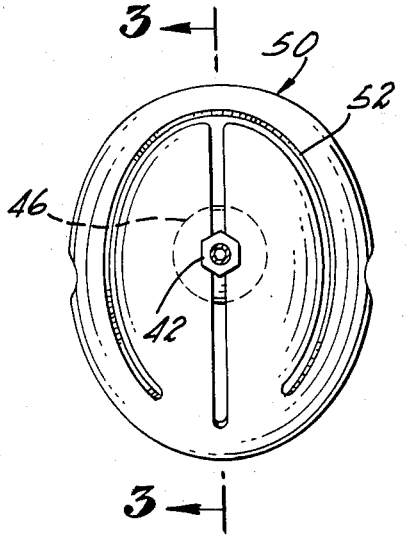
FIG. 2 shows a top view of the present invention.

Referring now to FIG. 1, where the present invention is generally referred to with numeral 10, it can be observed that it includes, basically, connecting member 20 that insures a substantially tight engagement to shower head H, conduit member 30, massaging head assembly 40 and helmet member 50.

Figure 4:
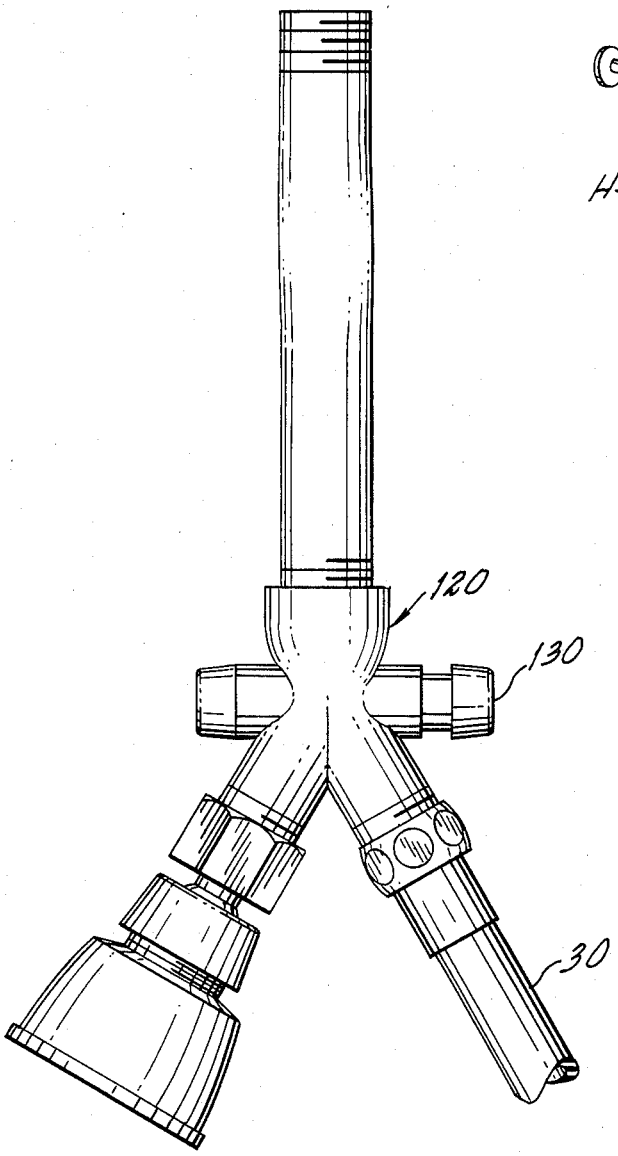
FIG. 4 is a partial view of the two-way valve assembly.
Figure 5:
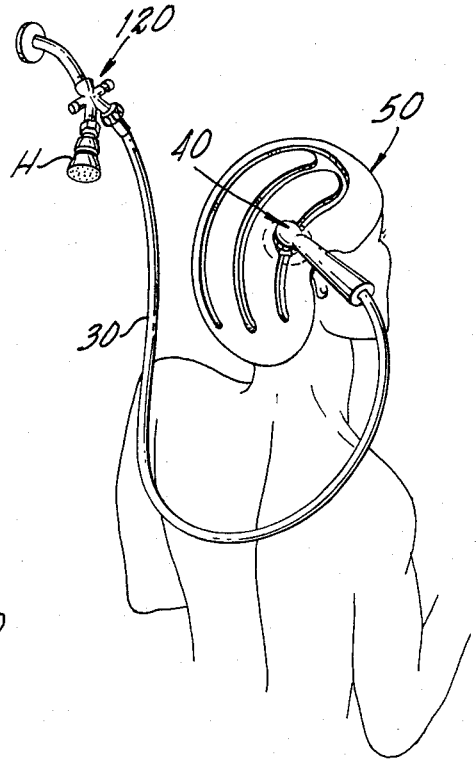
FIG. 5 shows the invention with the two-way valve assembly.

Connecting member 20 has preferably the shape of a cup and it is made out of an elastic material so that it produces a substantially water tight engagement with shower head H. Other methods for achieving this engagement may be utilized provided that they can be easily mounted and demounted from conventional shower heads. One of such alternate methods is illustrated in FIG. 4 and 5 where a two way valve assembly

120 permits a user to select either conventional shower head H or massager 10 by actuating/valve element 130.

Figure 3:
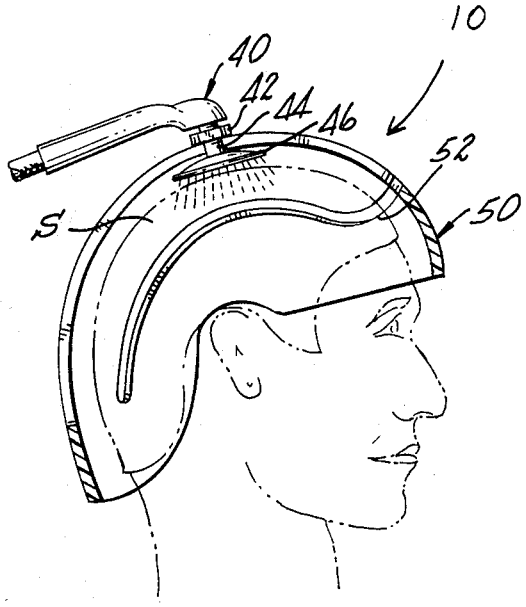
FIG. 3 illustrates a cross-sectional view of the massager shown in FIG. 2, taken along line 3—3.

Conduit member 30 is preferably a flexible tube capable of routing the necessary water supply to pulsating water massage head member 40 at one end of member 30. The other end of member 30 is, of course, tightly connected to connector 20. Massaging head member 40 includes an adjustable locking nut 42 that permits securing head member 40 in a desired position for directing the pulsating water action in a particular area of the scalp. Member 40 travels along slots 52 that run through paths along helmet member 50 that have been preselected to cover most, if not all, of the areas of the scalp. Massage head member 40 includes threaded neck 44 that extends inwardly and outwardly from helmet member 50 with a flatened head portion 46 at the end that protrudes inside. Locking nut 42 and portion 46 keep massage head member slidably in place, as best seen in FIG. 3.

The pulsating water coming out of massage head member 46 hits the user's scalp S and runs downwardly over the user's body to rinse him or her. This way a user not only gets a scalp massage but also use the water to rinse himself.

Helmet member 50 is preferably made out of a water resistant resilient material and it should have such dimension and shape so that it conforms with the user's head and stays in place.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

I claim:

1. A scalp massager, for connecting to a tap water supply, comprising:

A. a helmet member having a plurality of interconnected slots through its surface;

B. one and only one water pulsating and massaging head member slidably mounted in said helmet slots so that said head member may be moved to any position in any of said slots, said head member being positioned to direct water inwardly toward a user's scalp; and C. conduit means having two ends, one of said ends being connected to said head member, and the other of said ends being removably connected to said tap water supply, said head member including means to direct a jet of pulsating water onto a user's scalp, and being movable in said slots to direct said jet onto different areas of a user's scalp.

2. The massager set forth in claim 1 wherein said head member further includes fastening means securing said head member in a predetermined position along said slots.

3. The massager set forth in claim 2 wherein said head member includes a neck member that protrudes inwardly and outwardly through said slots and further including a flattened head portion at the inwardly protruding end of said member.

4. The massager set forth in claim 3 further including:

D. two-way valve means for selectively connecting said conduit member to said water supply.

* * * * *